United States Patent [19]

Lippolt

[11] Patent Number: 5,022,212

[45] Date of Patent: Jun. 11, 1991

[54] MOLDING STRUCTURE

[76] Inventor: Thomas Lippolt, 3574 Centerview Ave., Wantagh, N.Y. 11793

[21] Appl. No.: 399,695

[22] Filed: Aug. 28, 1989

[51] Int. Cl.[5] ..... E04C 2/38

[52] U.S. Cl. ..... 52/815; 52/222; 52/254

[58] Field of Search ..... 52/816, 716, 670, 410, 52/287, 222, 815, 254, 255, 256; 160/371, 380

[56] References Cited

U.S. PATENT DOCUMENTS

| | | | |
|---|---|---|---|
| 2,313,990 | 3/1943 | Crandell . | |
| 2,314,523 | 3/1943 | Speer . | |
| 3,201,910 | 8/1965 | Keesee . | |
| 3,391,037 | 7/1968 | McNulty . | |
| 3,579,409 | 5/1971 | Shannon . | |
| 3,657,850 | 4/1972 | Billarant | 52/716 X |
| 3,848,380 | 11/1974 | Assael | 52/222 |
| 3,909,994 | 10/1975 | Richter | 52/222 X |
| 4,408,433 | 10/1983 | Scherrer | 52/222 X |
| 4,765,039 | 8/1988 | Rowlands et al. | 52/222 X |

*Primary Examiner*—Carl D. Friedman
*Assistant Examiner*—L. Hoffert

[57] ABSTRACT

This invention relates to a novel design and construction of a molding structure wherein there is incorporated a mesh member capable of being structurally as well as adhesively and/or mechanically affixed to the molding member of molding structure by use of well known adhesives and/or fastening means, said molding member having formed therein, and in direct relationship to the placement of mesh member, recesses capable of allowing for the expansion and/or shifting of the mesh member and/or adjacent surfaces as well as allowing for additional surface area for receipt of adhesive material, be it in the form of spackling compound, or otherwise, same being such as to provide for the fashioning of an even surface between an adjacent wall surface and an opening appearing therein.

2 Claims, 2 Drawing Sheets

MOLDING STRUCTURE

BACKGROUND AND OBJECTS OF THE INVENTION

With regard to the present invention, it is well known within the prior art that mesh material in combination with molding and spackling compound is capable of utilization for purposes of providing a finished surface between a wall surface and an edge thereof, either as related to door jams, window openings, ceiling locations, floor locations, and the like. In conjunction with the above, and as disclosed in the prior art, various techniques have been taught and disclosed to accomplish the above, said prior art teachings being as follows, to wit, U.S. Pat. No. 2,313,990, Crandell, dated Mar. 16, 1943; U.S. Pat. No. 2,314,523, Speer, dated Mar. 23, 1943; U.S. Pat. No. 3,201,910, Keesee, dated Aug. 24, 1965; U.S. Pat. No. 3,391,037, McNulty, dated July 2, 1968; and U.S. Pat. No. 3,579,409, Shannon, dated May 18, 1971.

Although the prior art techniques have sought to assist tradesmen in construction as related to finishing of wall surfaces, the locations adjacent to door jams, window openings, ceilings, floors, and the like, none of same address themselves to the novel design and construction of the present molding structure herein disclosed and otherwise taught, same providing unique advantages and otherwise overcoming a number of disadvantages inherent in said prior art teachings.

It is. therefore, an object of the present invention to create a new and novel design for a molding structure utilizing mesh material and a molding member in combination that overcomes the various problems and disadvantages inherent in prior art teachings.

It is another object of the present invention to create a novel design for a molding structure wherein there is achieved the ability to utilize a mesh material in conjunction with a molding member whereby increased surface area for bonding occurs as between said mesh material and said molding member.

It is another object of the present invention to create a novel design for a molding structure so as to provide a structure capable of allowing for the expansion and/or shifting of adjacent surfaces, be it the mesh member and/or adjacent spackling compound, without necessitating the cracking thereof.

It is another object of the present invention to create a novel design for a molding structure whereby there is achieved the ability to allow for spackling compound to assist in providing adhesion between the mesh member and the molding member of said molding structure by having same fill the recesses formed in the molding member while additionally forming and overcoating of the mesh member.

The objects and advantages of the invention are set forth in part herein and in part will be obvious herefrom, or may be learned by practice of the invention, the same being realized and attained by means of the instrumentalities and combinations pointed out in the appended claims.

The invention consists in the novel parts, constructions, arrangements, combinations and improvements herein shown and described.

BRIEF DESCRIPTION OF THE INVENTION

This invention relates to a novel design and construction of a molding structure wherein there is incorporated a mesh member capable of being structurally as well as adhesively and/or mechanically affixed to the molding member of said molding structure by use of well known adhesives and/or fastening means, said molding member having formed therein, and in direct relationship to the placement of said mesh member, recesses capable of allowing for the expansion and/or shifting of the mesh member and/or adjacent surfaces as well as allowing for additional surface area for receipt of adhesive material, be it in the form of spackling compound, or otherwise, same being such as to provide for the fashioning of an even surface between an adjacent wall surface and an opening appearing therein.

DESCRIPTION OF A PREFERRED EMBODIMENT

Figure 1:
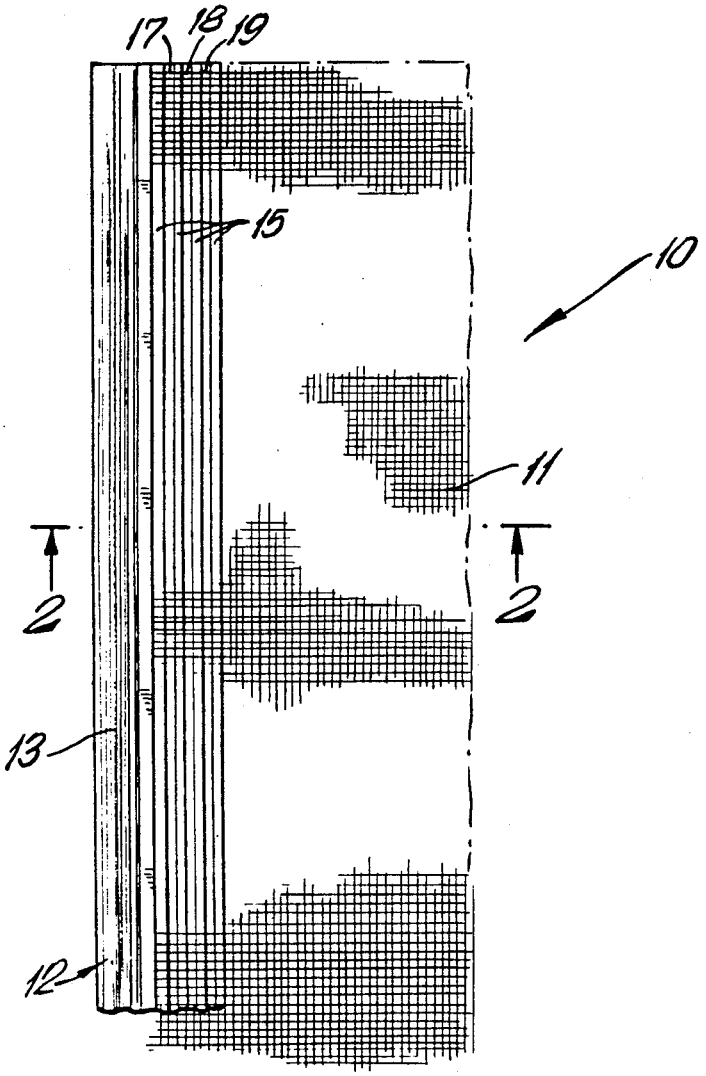
FIG. 1 is a partial top elevational view of a portion of molding structure utilized in accordance with the invention evidencing the interrelationship between the mesh member and the molding member of said molding structure.

Reference is herein made to FIG. 1 wherein there is depicted molding structure 10 constructed in accordance with the invention wherein mesh member 11 and molding member 12 of molding structure 10 are specifically depicted.

It should be noted that in conjunction with the invention, molding member 12 can be made from any material well known within the prior art for utilization as a molding, be same wood, plastic, or compositions thereof, and/or the like. Additionally, molding member 12 can be fashioned in most any cross sectional shape and/or size consistent with well known shapes presently utilized within the building industry for moldings.

Figure 2:
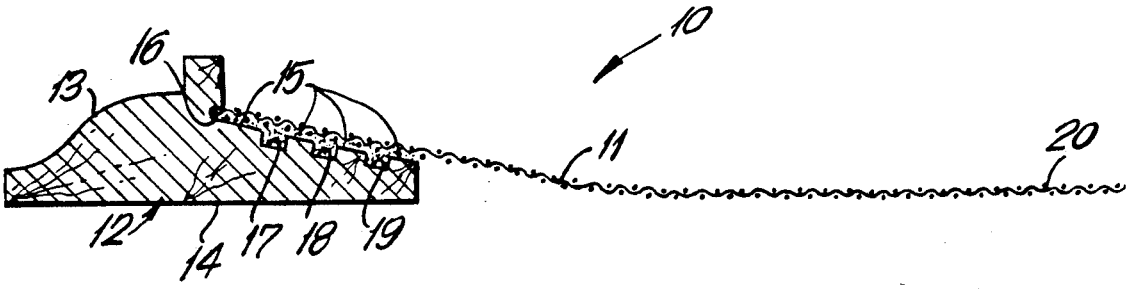
FIG. 2 is a cross sectional view of the molding structure depicted in FIG. 1 taken along lines 2—2 thereof.

As depicted in FIG. 2, molding member 12 as therein illustrated consists of an exterior surface 13, an adjacent surface 14 and a bonding surface 15.

In keeping with the invention, exterior surface 13 can be of any geometric shape, same in effect being that portion of molding member 12 that is visible upon completion of construction and would appear adjacent to a door jam, window, and the like. Adjacent surface 14 of molding member 12 represents that portion of molding member 12 that is structurally adjacent to a wall surface or other surface about which molding member 12 is positioned and in effect is hidden from view upon completion of construction.

In conjunction with bonding surface 15, a key way cut 16 is fashioned therein as depicted in FIG. 2 running parallel to the length of molding member 12. Additionally, and fashioned parallel to key way cut 16, are indent cuts 17, 18 and 19.

In keeping with the invention, mesh member 11 is placed upon the surface of bonding surface 15 of molding member 12 and is adhesively affixed thereto in accordance with well known prior art techniques same to include various adhesive materials or various mechanical fastening means. Thereafter, and in conjunction with the finishing of the surface between the adjacent wall surface as the case may be and bonding surface 15 of molding member 12, spackling compound 20 is applied on top of mesh member 11, inclusive of that portion of mesh member 11 that overlaps bonding surface 15 of molding member 12 so as to provide a uniform surface there above as well as to fill indent cuts 17, 18 and 19 formed within bonding surface 15 of molding member 12.

In this fashion, there is achieved the ability to utilize spackling compound 20, not only as a means to achieve a uniformed finished surface in conjunction with the utilization of molding member 12 as related to a construction surface such as a wall surface, but additionally, there is achieved the ability to have spackling compound 20 act as an adhesive material between mesh member 11 and molding member 12 due to the increase in surface area to which spackling compound 20 can adhere as related to molding member 12 as a result of the increase of bonding surface 15 due to indent cuts 17, 18 and 19 as depicted in FIG. 2.

Additionally, and in keeping with the invention, and as indicated in FIG. 2, key way cut 16 is formed adjacent to bonding surface 15 of molding member 12 as therein illustrated, said key way cut 16 running the entire length of molding member 12.

As illustrated in FIG. 2, mesh member 11 is placed upon bonding surface 15 of molding member 12 with the edge of mesh member 11 set partially into key way cut 16, therebeing left sufficient room for mesh member 11 to move laterally to the surface of bonding surface 15 into the remaining space formed by key way cut 16 should there be a shifting in construction surfaces and/or expansion of construction materials after the completion of work has occurred where molding structure 10 has in fact been installed. By utilizing key way cut 16 in the manner and fashion as hereinabove set forth, there is achieved a degree of insurance that the utilization of molding structure 10 will avoid, after the installation thereof, in accordance with the invention, any cracking and/or disfigurement of the adjacent surfaces abutting molding structure 10 as a result of shifting and/or expansion of building the structure.

Figure 3:
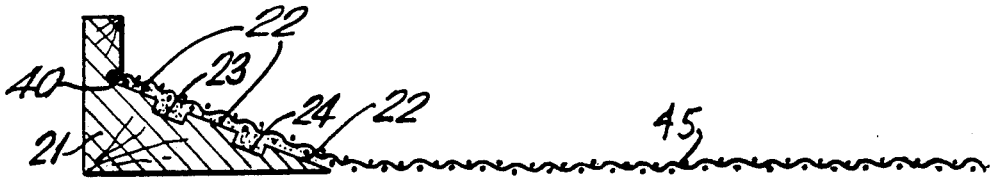
FIG. 3 is a cross sectional view of an alternative molding structure evidencing an alternative embodiment of the invention.

In keeping with the invention, there is set forth in FIG. 3 an alternative embodiment of the invention wherein molding member 21 is depicted having its own bonding surface 22 wherein there is formed indent cuts 23 and 24 and key way cut 40. As with molding member 12, mesh member 45 is placed upon bonding surface 22 of molding member 21 and partially into key way cut 40 and is adhesively affixed thereto in accordance with well-known prior art techniques.

Figure 4:
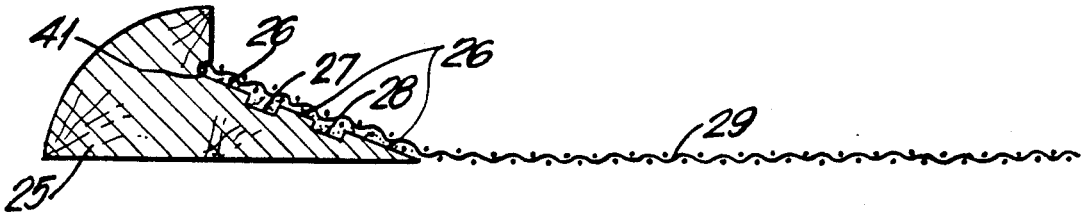
FIG. 4 is a cross sectional view of an alternative molding structure evidencing an alternative embodiment of the invention.

Similarly, there is set forth in FIG. 4 an alternative embodiment of the invention wherein molding member 25 is depicted having its own bonding surface 26 wherein there is formed indent cuts 27 and 28 and key way cut 41. As with molding member 12, mesh member 29 is placed upon bonding surface 26 of molding member 25 and partially into key way cut 41 and is adhesively affixed thereto in accordance with well-known prior art techniques.

Figure 5:
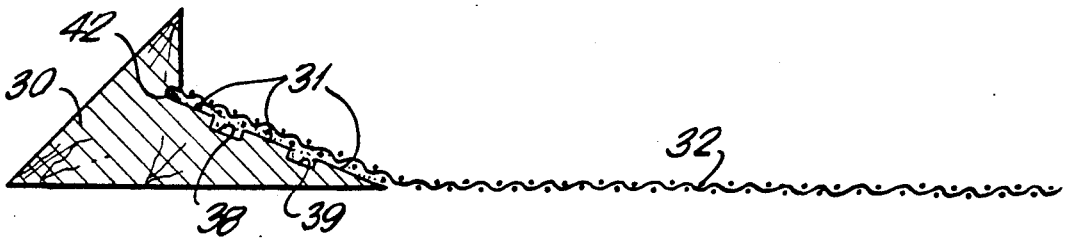
FIG. 5 is a cross sectional view of an alternative molding structure evidencing an alternative embodiment of the invention.

Similarly, there is set forth in FIG. 5 another alternative embodiment of the invention wherein molding member 30 is depicted having its own bonding surface 31 wherein there is formed indent cuts 38 and 39 and key way cut 42. As with molding member 12, mesh member 32 is placed upon bonding surface 31 of molding member 30 and partially into key way cut 42 and is adhesively affixed thereto in accordance with well-known prior art techniques.

Figure 6:
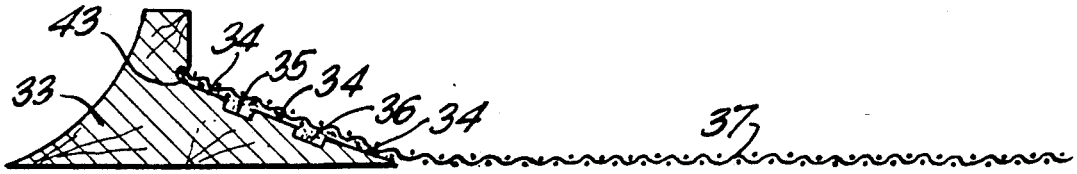
FIG. 6 is a cross sectional view of an alternative molding structure evidencing an alternative embodiment of the invention.

Similarly, there is set forth in FIG. 6 another alternative embodiment of the invention wherein molding member 33 is depicted having its own bonding surface 34 wherein there is formed indent cuts 35 and 36 and key way cut 43. As with molding member 12, mesh member 37 is placed upon bonding surface 34 of molding member 33 and partially into key way cut 43 and is adhesively affixed thereto in accordance with well-known prior art techniques.

It is in keeping with the invention, that the present inventive concepts as herein disclosed are not limited to a particular cross section of molding, but rather, is applicable to any molding cross section nor the number of indent cuts utilized, it being within the scope of this invention for said inventive principles and concepts to be applicable to any one of a number of molding cross sections and/or indent cuts.

The preceding description and accompanying drawings relate primarily to a specific embodiment of the invention, and the invention in its border aspects should not be so limited to one specific embodiment as herein shown and described, but departures may be made therefrom within the scope of the accompanying Claims without departing from the principles of the invention and without sacrificing its chief advantages.

I claim:

1. A molding structure for utilization in conjunction with the finishing of two adjacent surfaces comprising;

(a) a molding member defining through its entire length parallel indent cuts formed along a common surface thereof as well as a keyway cut additionally being parallel to said indent cuts;

(b) a mesh member structurally affixed to that portion of said molding member that has formed within its surface said indent cuts, said mesh member having one of its exposed edges positioned partially within said keyway cut;

(c) bonding means capable of structurally bonding said mesh member to said molding member by contacting said mesh member, said indent cuts and said keyway cut.

2. A molding structure for utilization in conjunction with the finishing of two adjacent surfaces as set forth in claim 1 wherein said bonding means is spackling compound.

* * * * *